United States Patent [19]

Janko et al.

[11] Patent Number: 4,927,057

[45] Date of Patent: May 22, 1990

[54] AUTOMATIC INFLATOR FOR INFLATABLE ARTICLES

[75] Inventors: Michael Janko, Richmond, Mich.; Matthew McAllister, Lexington, both of Mich.

[73] Assignee: Inflation Technologies & Innovation, Anchorville, Mich.

[21] Appl. No.: 359,875

[22] Filed: May 30, 1989

[51] Int. Cl.[5] ..... B67B 7/24

[52] U.S. Cl. ..... 222/5; 222/23; 222/41; 222/52; 222/63; 441/93; 441/94

[58] Field of Search ..... 222/3, 5, 54, 63, 23, 222/61, 41, 52, 333; 441/92, 93, 94, 95, 41

[56] References Cited

U.S. PATENT DOCUMENTS

| | | | |
|---|---|---|---|
| 1,329,990 | 2/1920 | Muller . | |
| 2,527,605 | 10/1950 | Walk . | |
| 2,627,998 | 2/1953 | Musser et al. . | |
| 2,675,143 | 4/1954 | Seemann, Jr. . | |
| 2,701,886 | 2/1955 | Ivie . | |
| 2,894,658 | 7/1959 | Spidy . | |
| 2,904,217 | 9/1959 | Gurney . | |
| 2,944,268 | 7/1960 | Fruendt . | |
| 2,964,050 | 12/1960 | Novak . | |
| 3,059,814 | 10/1962 | Poncel et al. . | |
| 3,077,288 | 2/1963 | Henry . | |
| 3,090,979 | 5/1963 | Segrest . | |
| 3,127,624 | 4/1964 | Kubit et al. . | |
| 3,193,140 | 7/1965 | Trauger . | |
| 3,198,384 | 8/1965 | Anderson . | |
| 3,221,932 | 12/1965 | Anderson . | |
| 3,242,514 | 3/1966 | Waters . | |
| 3,266,668 | 8/1966 | Davis . | |
| 3,308,494 | 3/1967 | Licher . | |
| 3,350,730 | 11/1967 | Kubit et al. . | |
| 3,426,942 | 2/1969 | McMains et al. . | |
| 3,494,506 | 2/1970 | Fujimoto . | |
| 3,510,025 | 5/1970 | Turner, Jr. . | |
| 3,526,339 | 9/1970 | Bernhardt et al. . | |
| 3,630,413 | 12/1971 | Beckes . | |
| 3,682,354 | 8/1972 | Witte | 222/3 |
| 3,693,202 | 9/1972 | Ohtani . | |
| 3,716,882 | 2/1973 | Middleton, Jr. et al. . | |
| 3,802,012 | 4/1974 | Middleton, Jr. . | |
| 3,812,546 | 5/1974 | Witte . | |
| 3,815,783 | 6/1974 | Hirata . | |
| 3,833,029 | 9/1974 | Munn . | |
| 3,910,457 | 10/1975 | Sutliff et al. | 222/5 |
| 3,934,292 | 1/1976 | Mulderrig . | |
| 3,997,079 | 12/1976 | Niemann . | |
| 4,094,028 | 6/1978 | Fujiyama et al. . | |
| 4,191,310 | 3/1980 | Bernhardt et al. . | |
| 4,223,805 | 9/1980 | Mackal | 222/5 |
| 4,246,672 | 1/1981 | Fujiyama et al. . | |
| 4,260,075 | 4/1981 | Mackal | 222/5 |
| 4,267,944 | 5/1981 | Mackal | 222/5 |
| 4,475,664 | 10/1984 | Mackal | 222/5 |
| 4,482,081 | 11/1984 | Meggs | 222/5 |
| 4,493,664 | 1/1985 | Dale . | |
| 4,498,604 | 2/1985 | Mackal | 222/5 |
| 4,498,605 | 2/1985 | Mackal et al. | 222/5 |
| 4,500,014 | 2/1985 | Zimmerly | 222/5 |
| 4,524,885 | 6/1985 | Zimmerly | 222/5 |
| 4,629,436 | 12/1986 | Stewart | 222/5 X |

*Primary Examiner*—Kevin P. Shaver
*Attorney, Agent, or Firm*—Basile and Hanlon

[57] ABSTRACT

An inflator for automatically inflating an inflatable article, such as a personal flotation vest, upon immersion in water. A plunger is mounted in a housing and is movable with respect to a pressurized gas canister attached to the housing. An actuator mechanism, mounted within the housing, acts on the plunger to move the plunger to pierce the canistor to release the pressurized gas through the housing to the inflatable article attached to the housing. A pair of spaced water sensor probes provide a signal to a control device mounted within the housing when immersed in water. The control device automatically activates the actuator to drive the piercing end of the plunger into the canister. A manual lanyard is extensibly mounted within the housing and is connected to a link and lever to drive the plunger into the canister when the lanyard is pulled outward from the housing.

17 Claims, 2 Drawing Sheets

AUTOMATIC INFLATOR FOR INFLATABLE ARTICLES

BACKGROUND OF THE INVENTION

1. Field of the Invention

The present invention relates, in general, to inflatable articles and, more specifically, to inflators for inflatable articles, such as personal flotation devices, life vests, rafts, etc.

Personal flotation devices (PFDs), commonly known as life vests or jackets, and other inflatable articles, such as rafts, etc., have been devised to inflate and serve as a flotation device for a person immersed in water. Such devices typically employ a pressurized gas canister or cylinder, such as a carbon dioxide cylinder, which, when pierced, releases gas to inflate the attached article. A manual operating lever or lanyard is employed to move a spring biased pin into the gas canister to pierce and release the gas therefrom.

While such devices are effective, such manually operated inflators require the use of energy by the wearer to activate the inflator to release the gas to inflate the article. If the wearer is disabled or unconscious, he is unable to actuate the inflator to inflate the article.

To overcome such a problem, automatic inflators have been devised which singly, or in combination with a manual lanyard, automatically inflate a vest or raft when immersed in water. Such automatic inflators typically include a pill or a member formed of a material which is responsive to water and which dissolves or changes in volume or dimension when subject to water. The pill or member, when altered, releases a spring-loaded striker or plunger to pierce the gas canister and release the gas therefrom to inflate the attached article. In other such devices, the disintegration of the pill or member upon exposure to moisture or water causes an explosive charge to detonate to actuate the canister piercing pin.

While such actuators automatically inflate articles without manual intervention, they are not without their deficiencies. Such actuators take a measurable amount of time, i.e., several seconds, for the pill to disintegrate before actuating the device to release the gas and inflate the article. This time delay may be critical in certain uses to prevent injury or drowning of the wearer of the inflatable article. Further, such automatic inflators are relatively unreliable in that they have been proven to operate only two-thirds of the time when exposed to water. Further, such automatic inflators provide little or no ready indication of a fully charged gas canister. Such inflators also provide no indication of an operative inflator.

Improved automatic inflators have been devised which utilize probes or conductors mounted in the inflator body and which form a part of an electrical circuit used to automatically drive a plunger into the pressurized gas canister. When the housing is fully immersed in water, a circuit is closed between the probes which supplies electric power to an actuating mechanism, i.e., such as an explosive charge which detonates to drive the plunger into the canister. While such inflators are an improvement over previously devised automatic inflators, care must be taken to prevent premature actuation due to a splash of water when the housing is not fully immersed in water. Further, such improved automatic inflators still provide no indication of a spent or empty gas canister nor the operative state of the inflator actuating mechanism.

Thus, it would be desirable to provide an automatic inflator for inflatable articles which automatically inflates an inflatable device without user intervention. It would also be desirable to provide an automatic inflator which quickly inflates an inflatable article when immersed in water. Finally, it would be desirable to provide an automatic inflator for inflatable articles which provides an easily visible indication of the condition of the gas canister, i.e., whether charged or pierced, as well as the operative state of the inflator actuating mechanism.

SUMMARY OF THE INVENTION

The present invention is an automatic inflator for inflatable articles which automatically releases pressurized gas to inflate such articles upon immersion in water. The inflator includes a housing having means for discharging pressurized gas to the inflatable article. A pressurized gas canister is removably attached to the housing and is disposed in fluid flow communication with the gas discharging means in the housing. A plunger is movably mounted within the housing with respect to and facing the gas canister. The plunger is provided with a canister piercing end.

An electrical power source is mounted in the housing and is connected to a water sensor means, also mounted on the housing. The water sensor means detects immersion of the housing in water and outputs a signal to a control means. An automatic actuating means is provided to drive the plunger into the canister when the inflator is immersed in water. In a preferred embodiment, the automatic actuating means includes a cam means, a motor means and a gear means. The cam means is mounted within the housing and acts on the plunger for urging the piercing end of the plunger into the canister to pierce the canister and release the pressurized gas therefrom. The motor means has a rotatable output shaft which is coupled to a gear means which acts on the cam means. Activation of the motor means, when the water sensor means detects immersion in water, activates the motor means which, through the gear means, rotates the cam and drives the plunger into the canister thereby piercing the canister and releasing the pressurized gas therefrom to inflate the inflatable article attached to the inflator.

The inflator also includes a control means, preferably a central processing unit, which is connected and responsive to the water sensor means. The control means controls the actuation of the motor means in response to an output from the water sensor means. Finally, manual operating means is mounted in and extends from the housing for manually rotating the cam means to drive the plunger into the canister when the manual operating means is activated.

In a preferred embodiment, the inflator of the present invention includes means for detecting the position of the plunger to provide an indication of the operative state of the gas canister. In this manner, a ready indication through a visible indicator mounted on the housing is provided to indicate whether the canister is fully charged or has been pierced and is empty. Additional indicators are also provided in the housing and driven by the control means to indicate the operative state of the inflator insofar as having sufficient electrical power to activate the inflator, as well as provide an indication of any internal fault condition which would prevent the operation of the inflator.

The inflator of the present invention automatically inflates an inflatable article attached thereto with pressurized gas immediately upon immersion in water. The water sensor probes are mounted in the housing in such a manner as to prevent their activation in generating an output signal due only to a splash or a momentary contact with water. This requires that the sensor be fully immersed in water before generating an output signal to activate the inflator.

The inflator includes both automatic, as well as manual activating means. Most importantly, the inflator of the present invention provides visible indication of the state of the gas canister, i.e., whether fully charged or empty. In addition, the control means drives several indicators which provide a visible indication of the operative state of the inflator with regard to electrical power levels sufficient to activate the inflator, as well as the presence of any fault condition which would prevent the operation of the inflator in an automatic mode.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
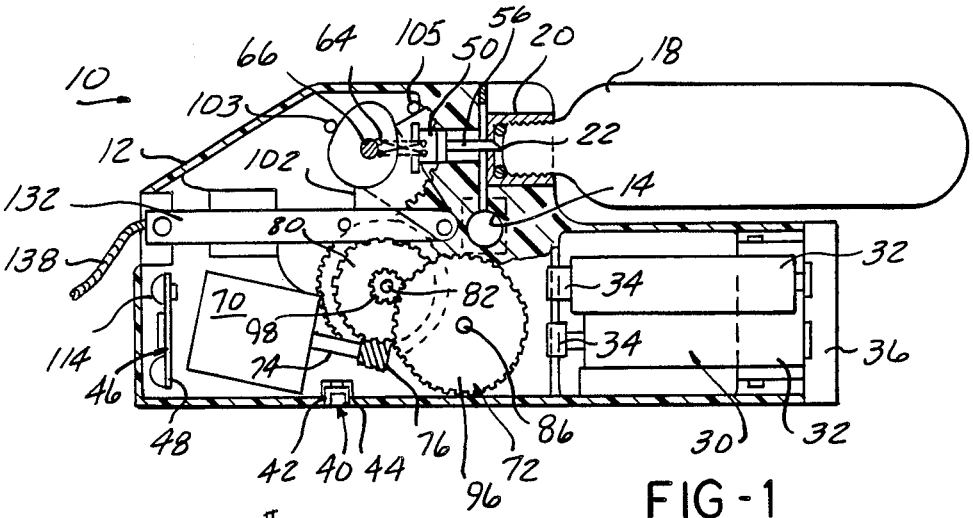
FIG. 1 is a front elevational view, partially broken away, of an automatic inflator constructed in accordance with the teachings of the present invention.

Throughout the following description and drawing, an identical reference number is used to refer to the same component shown in multiple figures of the drawing.

Figure 2:
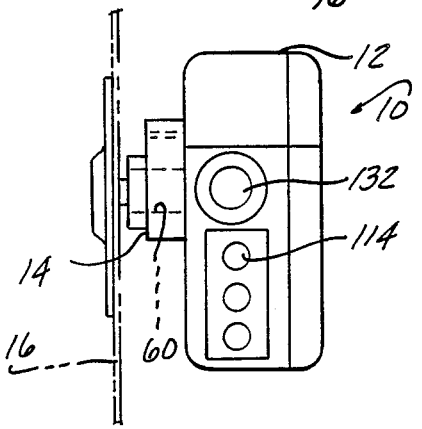
FIG. 2 is a left-hand end view of the inflator shown in FIG. 1.

Referring now to the drawing, and to FIGS. 1 and 2, in particular, there is illustrated an inflator 10 for inflating an inflatable article, such as a personal flotation device, raft, etc. The inflatable article with which the inflator 10 is used may comprise any type of article which is inflated by pressurized gas released from the inflator 10.

The inflator 10 includes a waterproof housing 12, preferably formed of a plastic material. The housing 12 is hollow or has portions bored throughout for receiving the various components, described below, which form the operative elements of the inflator 10. Suitable seals may also be provided to mount the water sensors and gas canister, as described hereafter, on the housing 12 and to make the housing 12 waterproof.

As shown in FIGS. 1 and 2, the housing 12 is connected by a suitable fluid flow conduit 14 to the inflatable article 16. Any suitable mounting means, such as a quick release valve, may be employed to attach the inflator housing 12 to the inflatable article 16 and such mounting means may be permanent or removable.

The pressurized gas canister 18 which is attached to the housing 12 may be any conventional pressurized gas canister, such as one containing carbon dioxide ($CO_2$) or any other fluid commonly employed to inflate an inflatable article 16. The canister 18 is preferably in the form of a metal container having a threaded end portion 20 formed adjacent one end and a piercible end portion 22 situated within the threaded end portion 20 and facing outward from one end of the canister 18. The threads 20 on one end of the canister 18 are threadingly received in a threaded bore 23 formed in a threaded metallic insert 24 molded or otherwise mounted in housing 12. A face seal 25 is mounted in the insert 24 to prevent gas from escaping exteriorly from the housing 12 and to prevent water from entering the housing 12. An aperture 27 is formed in one end of the insert 24 to receive the piercing rod, as described in detail hereafter.

An electric power source, denoted generally by reference number 30 in FIG. 1, is mounted within the housing 12 and provides electrical power to the electrically operated components of the inflator 10. The electric power source 30 comprises one or more storage batteries 32. The batteries 32 have contacts which engage mating contacts 34 mounted within the housing 12.

In a preferred embodiment, the electric power source 30 is removable by means of a cap 36 which is sealingly attached to one portion of the housing 12. This enables the batteries 32 to be replaced when their energy has been depleted. The cover 32 may be formed as a snap-on attachment to the housing 12 or may be connected to the housing 12 by threads.

Water sensor means, denoted by reference number 40, is mounted in the housing 12. Preferably, the water sensor means 40 comprises a pair of electric probes 42, which are in the form of thin metallic strips, mounted in a recess 44 formed in one portion of the housing 12. The probes 42 extend outward from the interior of the housing 12 and are completely surrounded by the peripheral extent of the recess 44. This prevents a splash or a drop of water from forming a conductive path between the probes 42 which would inadvertently activate the inflator 10. The electric power source 30 and the water sensor means 40 are electrically connected to a control means 46, shown generally in FIG. 1, and in detail in FIG. 5. The control means 46 is mounted on a circuit board 48 mounted within the housing 12.

Figure 5:
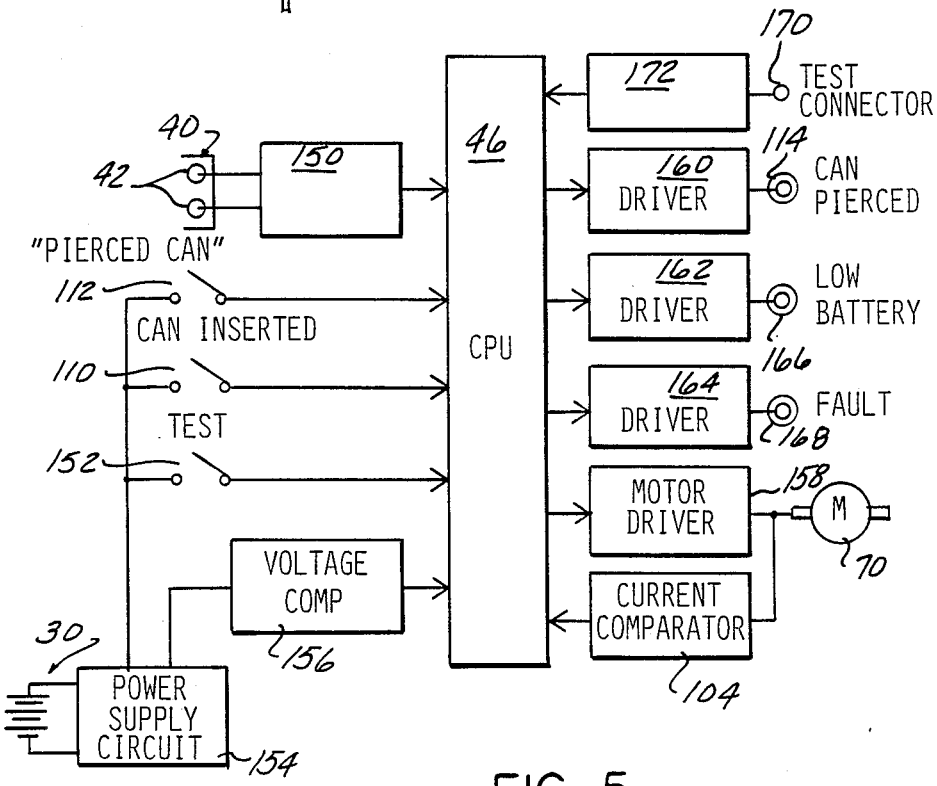
FIG. 5 is a schematic block diagram of the electric circuitry of the control means of the inflator of the present invention.

A control means 46 may comprise any type of electric circuit suitable for activating the inflator in response to immersion of the water sensor means 40 in water. Thus, a discrete component electronic circuit may be employed. In a preferred embodiment, however, the control means 46 comprises a central processing unit, such as a National Semiconductor microcomputer model No. NSCOP413C, which executes a stored program and activates the inflator in response to an input from the water sensor means 40. As shown in FIGS. 1, 2 and 5, the control means 46 receives as one input the output from the water sensor means 40.

Figure 4:
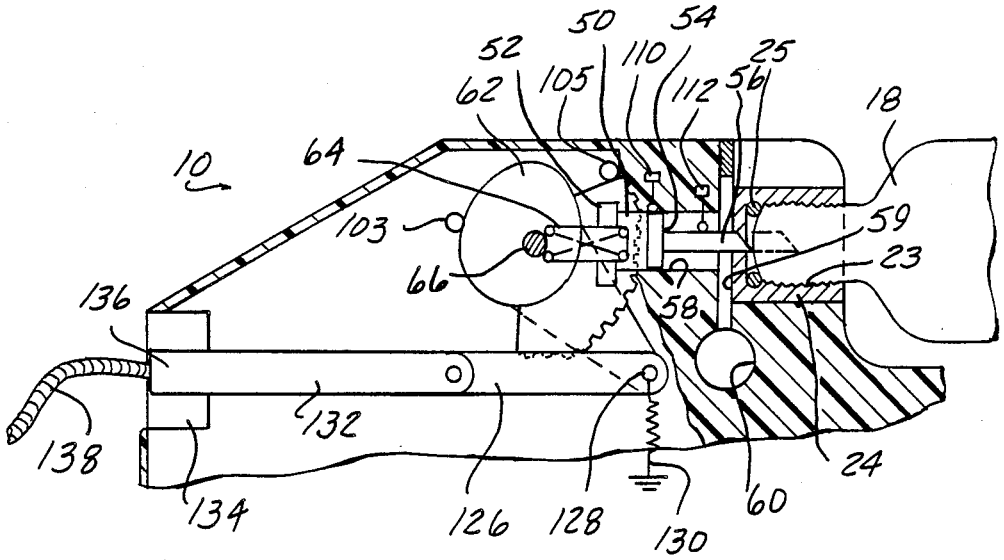
FIG. 4 is a partial, enlarged view of the actuator shown in FIG. 1.

The inflator 10 of the present invention also includes means for automatically actuating a plunger 50 to pierce the canister 18. The plunger 50, as shown in FIGS. 1 and 4, is movably mounted within the housing 12 and includes first and second end faces 52 and 54. An elongated piercing rod 56 extends from the second face 54 and is adapted to engage the end portion 22 of the gas canister 18, as shown in detail in FIG. 4. The piercing rod 56 is preferably in the form of a roll pin having an elongated open slot formed along its length which provides a fluid flow path for gas released from the gas canister 18 into the housing 12 and from the housing 12 to the inflatable article 16, as described in greater detail hereafter.

The plunger 50 is movably mounted within a bore 58 formed within the housing 12. Seal means, such as O-rings 51, are mounted on the plunger 50 for sealing the bore 58, as shown in FIGS. 2 and 4. A transverse bore 59 extends from the bore 58 and communicates with a fluid outlet 60. Thus, gas released from the gas canister 18 flows through the piercing rod 56 into the bores 58 and 59 in the housing 12 and from the bores 58 and 59 through the fluid outlet 60 into the inflatable article 16.

Figure 3:
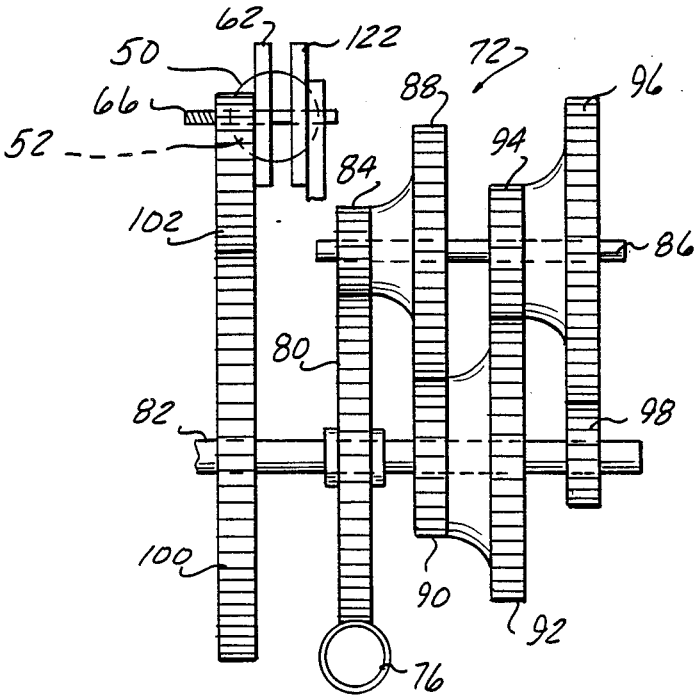
FIG. 3 is a roll-out plan view of the reduction gears shown generally in FIG. 1.

The automatic actuating means includes a first cam means 62, shown in FIGS. 1 and 3, which is rotatably mounted on a shaft 66 within the housing 12 and acts on the first end face 52 of the plunger 50. The eccentric shape of the cam 62 drives the plunger 50 toward the end 22 of the gas canister 18 under force causing the piercing rod 56 to pierce the end 22 of the gas canister 18 and release the pressurized gas therefrom. Biasing means 64 is mounted to the shaft 66 and engages the end face 52 of the plunger 50 to normally urge the plunger 50 toward and into contact with the gas canister 18 such that the piercing rod 56 normally engages, but does not pierce the sealed end 22 of the gas canister 18. The spring force of the spring 64 may be varied as desired and may, for example, be high enough to supply a portion of the force required to pierce the canister 18.

In a preferred embodiment, the automatic actuating means also includes a motor means 70, FIG. 1, and a gear reduction means, denoted generally by reference number 72 and shown in detail in FIGS. 1 and 3. The motor means 70 comprises any type of electric motor having an output shaft 74. The motor means 70 is responsive to the control means 46 and is activated in response to an output signal from the control means 46. A worm gear 76 is mounted on the end of the output shaft 74 of the motor means 70.

The gear reduction means 72 comprises a plurality of intermeshing gears which reduce the high revolution output of the motor 70 to a lower revolution suitable for rotating the cam 62 with sufficient torque to drive the piercing rod 56 attached to the plunger 50 into the sealed end 22 of the gas canister 18. A preferred embodiment of the gear reduction means is shown in FIG. 3. By way of example only, the gear reduction means 72 comprises a first gear 80 which is freely mounted about a shaft 82 disposed within the housing 12. The gear 80 is driven by the worm gear 76 attached to the output shaft 74 of the motor 70. A second gear 84 meshes with the first gear 80 and is freely rotatable about a second shaft 86, also mounted within the housing 12. The second gear is fixedly connected to or integrally formed with a third gear 88 also rotatably mounted about the shaft 86. The gear 88 meshes with a gear 90 integrally formed with another gear 92.

The gears 90 and 92 are freely rotatable about the shaft 82, as shown in FIG. 3. The gear 92 meshes with a gear 94 which is freely mounted with a gear 96 about the shaft 86. The gear 96 meshes with a gear 98 fixedly connected to the shaft 82 to thereby rotate the shaft 82. Rotation of the shaft 82 drives a gear 100, also fixedly connected to the shaft 82. The gear 100 engages a sector gear 102 which is joined to or integrally formed with the first cam means 62. In this manner, rotation of the output shaft 74 of the motor 70 is translated through the gear reduction means 72 to pivotal movement or rotation of the first cam 62 to drive the plunger 50 and the piercing rod 56 toward the gas canister 22.

Suitable stops 103 and 105 are formed internally within the housing 12 and are engaged by the sector gear 102 to prevent and limit the extent of travel of the sector gear 102 in both directions. As shown in FIG. 5, the motor 70 current is detected by a current comparator circuit 104 which is input to the central processing unit or control means 46 to indicate that further movement of the sector gear 102 is prevented when the sector gear 102 engages one of the stops 103 or 105. This causes the motor 70 to stall; which condition is acted on by the control means 46 to reverse movement of the sector gear 102 from an advanced position to a normal home position. The stop 105 at the home position will again prevent further movement of the sector gear 102 which will be detected by the current comparator 104 and will cause the control means 46 to deactivate the motor 70 until the next activation of the sensor 10.

It will be understood that the above-described description of the automatic actuating means is by way of example only as other actuating means may be employed to mechanically drive the plunger into the canister. Thus, an electromechanical solenoid, a spring/solenoid combination, a linear motor or a pivotal toggle linkage, each responsive to the control means when a signal is received from the water sensor, may also be employed in the inflator of the present invention.

As shown in FIG. 4, plunger position detector means 110 and 112 are mounted within the housing 12 to detect the position of the plunger 50. The position detector means 110 and 112 are preferably switches, such as limit switches or proximity switches, for example. The first detector means 110 provides an indication that the plunger 50 is in its retracted position; while the second detector means 112 detects an advanced position of the plunger 50 as occurs when the plunger 50 has been advanced by the cam 62 and the piercing rod 56 has pierced the end of the canister 18. The position detectors 110 and 112 thus provide an indication of the operative state of the canister 18, i.e., whether or not the canister 18 is charged or empty.

In normal operation, the spring 64 biases the plunger 50 such that the piercing rod 56 extends into the threaded insert 24 to the position shown in phantom in FIG. 4. Insertion of a fully charged, sealed gas canister 18 into the threaded insert 24 will urge the piercing rod 56 and the plunger 50 backward against the bias of the spring 64 or to the left in the orientation shown in FIG. 4. This causes the detector 110 to indicate that the plunger 50 is in its retracted position and also indicates, indirectly, that the gas canister 18 mounted in the housing 12 is sealed. The detector 110 is input to the control means 46 as is the second detector 112, as shown in FIG. 5.

When the plunger 50 has been advanced by the actuating means to pierce the canister 18 or when an empty canister 18 is present in the housing 12, the piercing rod 56 and the plunger 50 will move to the right under the bias of the spring 64 until the second detector 112 is made indicating that a pierced canister 18 is mounted in the housing 12.

The control means 46 generates outputs to an indicator 114 visible exteriorly from the housing 12 indicating that the gas canister 18 has been pierced. In this manner, the condition of the gas canister 18 is readily apparent to a user of the inflator 10. The indicator 114 may be any type of indicator, such as a light emitting diode or a liquid crystal display. Preferably, a magnetic switchable ball having two different colored faces is mounted within the housing 12 and driven by the control means 46 between two states. Thus, one colored face of the indicator 114 provides an indication that the gas canister 18 has been pierced and is empty.

When the housing 12 has been immersed in water, the water sensor means 40 will generate an output to the control means 46. The control means 46 then energizes the motor 70 causing the output shaft 74 and the worm gear 76 attached thereto to rotate. This rotation is translated through the gear reduction means 72 to rotation of the sector gear 102 and the first cam 62. Rotation of the cam 62 in the clockwise direction drives the plunger 50 to the right, as shown in the orientation of FIG. 4, urging the piercing rod 56 into the sealed end 22 of the gas canister 18 and releasing the pressurized gas therefrom. The pressurized gas flows through the piercing rod 56, the bores 58 and 59 in the housing 12 and the fluid outlet 60 into the inflatable article 16 causing inflation of the article 16.

As shown in FIGS. 1 and 4, the inflator 10 of the present invention is also provided with manual actuating means. In a preferred embodiment, the manual actuating means comprises a second cam means 122 freely mounted about the shaft 66 on which the first cam means 62 is mounted. The second cam means 122 has the same shape as the first cam means 62 and acts on the second end face 52 of the plunger 50 and functions in the same manner to urge the plunger 50 toward the sealed end 22 of the gas canister 18, as described above for the automatic inflation mode of the inflator 10.

The second cam means 122 is connected to or integrally formed with a lever 124. The lever 124 is pivotally connected at one end to a link 126. The pivot connection 128 between the lever 124 and the link 126 is biased by a biasing spring 130 to the right, as viewed in FIG. 4. The other end of the link 126 is pivotally connected to a lanyard 132. The lanyard 132 is in the form of an elongated rod movably mounted within a bushing 134 in the housing 12. One end 136 of the lanyard 132 extends exteriorly from the housing 112. A line or cord 138 is connected to the end 136 of the lanyard 132 and causes outward movement of the lanyard 132 from the housing 12 when pulled.

Thus, an outward pull on the cord 138 will cause the lanyard 132 to be pulled to the left, as shown in FIG. 4. This results in a pivoting of the link 126 resulting in a rotation of the lever 124 and the second cam 122. The second cam 122 is thus rotated clockwise to drive the plunger 50 toward the canister with the piercing rod 56 engaging and piercing the sealed end 22 of the canister 18 to release the gas therefrom.

Alternately, the manual actuating means may comprise a single piece lanyard, not shown, which is extendable at one end from the housing 12 via a cord 138. The opposite end of the lanyard acts directly on the end face 52 of the plunger 50 to drive the plunger 50 toward the canister 18 in the same manner as the cam 122, described above.

FIG. 5 depicts a schematic block diagram of the control circuitry employed in the inflator 10 of the present invention. As shown therein, the control means or central processing unit 46 receives an output signal from the water sensor means 40 which has been conditioned by suitable signal conditioning circuitry 150, Motorola Model Nos. MMBD7000 and MMBD2826, for example, to the proper voltage level. Also input to the control means 46 are the detector means 110 and 112 which detect the position of the plunger 50. A test input switch 152 is mounted on the housing 12 and is connected as an input to the control means 46 for initiating a self-test program stored within the control means 46. The self-test program exercises the inflator 10 and runs the inflator 10 through a partial cycle to detect if the motor 70 is stalled or is prevented from rotating the cam 62. The electrical power source 30 supplies power to the switches 110, 112 and 152, as well as the water sensor means 40 through a power supply circuit providing a regulated voltage output. The output of the power supply circuit 154 is also input through a voltage comparator 156, Intersil Model No. ICL 7665, to the control means 46.

The outputs from the control means 46 comprise a motor driver circuit 158, Sprague Model No. UDN-2592, which drives the motor 70. The output of the motor driver circuit 158 is input to a current comparator 104, such as of an amp, to detect a motor stalled condition, as described above. Suitable driver circuits 160, 162 and 164, Siliconix Model No. ZN7004 FET, are provided for the indicators 114, 166 and 168. The indicator 114 indicates when the canister 18 is pierced, as described above. Indicator 166, which is identical to the indicator 114, is mounted within the housing 12 and is visible exteriorly therefrom, as shown in FIG. 2. The indicator 166 provides an indication of low electrical power source. The fault indicator 168 is also identically constructed as the indicators 114 and 166 and is activated to indicate a fault condition when the control means 46, when executing the self-test program, encounters a fault state which would indicate that the inflator 10 is non-operative or cannot function properly.

Finally, a test connector input 170 is connected through suitable conditioning circuitry 172, Motorola Model Nos. MMBD7000 and MMBD2836, as an input to the control means 46 for connecting a test connector to the control means 46. This enables the control means 46 to be tested during assembly or at any time during its use for proper operation.

In summary, there has been disclosed a unique inflator for inflatable articles which automatically inflates such articles upon immersion in water. The inflator is also manually actuated by means of a manually operable lanyard. The inflator uniquely provides an indication of the condition of a pressured gas canister and provides a visible indication of whether the canister is sealed, thereby indicating a fully pressurized canister, or if it has been pierced and is therefore empty. This enables the operative state of the inflator to be easily detected at any time during storage and prior to use.

What is claimed is:

1. An inflator for inflatable articles comprising:

a housing;

means, formed in the housing for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom for generating an output signal when immersed in water;

actuating means, mounted within the housing and responsive to the output signal, for mechanically moving the plunger to urge the piercing end of the plunger into the canister;

a central processing unit, mounted within the housing and connected to the electrical power source, the actuating means and the water sensor means and executing a stored control program, the central processing unit being responsive to the output signal from the water sensor means to activate the actuating means when the water sensor means is immersed in water; and status indicator means, mounted within the housing and responsive to the central processing unit, for indicating the operative state of the inflator.

2. The inflator of claim 1 further including:

first detector means, mounted within the housing for detecting the attachment of a sealed canister to the housing and generating an attachment signal, the attachment signal being input to the central processing unit.

3. The inflator of claim 1 further including:

second detector means, mounted within the housing, for detecting a pierced canister mounted in the housing and generating a pierced signal, the pierced signal being input to the central processing unit.

4. The inflator of claim 1 further including:

first detector means, mounted within the housing for detecting the attachment of a sealed canister to the housing and generating an attachment signal, the attachment signal being input to the central processing unit; and second detector means, mounted within the housing, for detecting a pierced canister mounted in the housing and generating a pierced signal, the pierced signal being input to the central processing unit.

5. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom for generating an output signal when immersed in water;

actuating means, mounted within the housing, for mechanically moving the plunger to urge the piercing end of the plunger into the canister; and control means, mounted within the housing and connected to the electrical power source, the actuating means and the water sensor means, for activating the actuating means in response to the output signal from the water sensor means;

the actuating means including:

cam means, mounted within the housing, and acting on the plunger for urging the piercing end of the plunger into the canister to pierce the canister and release the pressurized gas therefrom;

motor means having a rotatable output shaft, the motor means being actuated by the control means; and gear means, coupled between the output shaft of the motor means and the cam means, for rotating the cam means upon rotation of the output shaft of the motor.

6. The inflator of claim 5 further including:

manual actuating means for urging the piercing end of the plunger into the canister to pierce the canister and release the pressurized gas therefrom.

7. The inflator of claim 6 wherein the manual actuating means comprises:

a second cam means mounted within the housing and acting upon the plunger;

a lever fixedly connected to the second cam means;

a lanyard extensively mounted within the housing and pivotally connected at one end to the lever to cause rotation of the lever and the attached second cam means upon extension of the lanyard from the housing.

8. The inflator of claim 5 wherein:

the gear means comprises a plurality of intermeshing gears.

9. The inflator of claim 5 wherein:

the canister is removably attached to the housing.

10. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom for generating an output signal when immersed in water;

actuating means, mounted within the housing, for mechanically moving the plunger to urge the piercing end of the plunger into the canister;

control means, mounted within the housing and connected to the electrical power source, the actuating means and the water sensor means, for activating the actuating means in response to the output signal from the water sensor means; and first detector means, mounted within the housing for detecting the attachment of a sealed canister to the housing, the first detector means being input to the means.

11. The inflator of claim 10 further including:

biasing means, mounted in the housing and engaging the plunger, for normally biasing the plunger into contact with the canister.

12. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom for generating an output signal when immersed in water;

actuating means, mounted within the housing, for mechanically moving the plunger to urge the piercing end of the plunger into the canister;

control means, mounted within the housing and connected to the electrical power source, the actuating means and the water sensor means, for activating the actuating means in response to the output signal from the water sensor means; and second detector means, mounted within the housing, for detecting a pierced canister mounted in the housing.

13. The inflator of claim 12 further including:

biasing means, mounted in the housing and engaging the plunger, for normally biasing the plunger into contact with the canister.

14. The inflator of claim 12 wherein:

the second detector means is mounted in the housing to detect the position of the plunger after the plunger has moved toward and the piercing rod has pierced the canister.

15. The inflator of claim 14 further including:

a status indicator, mounted in the housing and responsive to the control means and the second detector means, for indicating a pierced condition of the canister.

16. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom for generating an output signal when immersed in water;

actuating means, mounted within the housing, for mechanically moving the plunger to urge the piercing end of the plunger into the canister;

control means, mounted within the housing and connected to the electrical power source, the actuating means and the water sensor means, for activating the actuating means in response to the output signal from the water sensor means; and status indicator means, mounted within the housing and responsive to the control means, for indicating the operative state of the inflator.

17. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

biasing means, mounted in the housing and engaging the plunger, for normally biasing the plunger into contact with the canister;

cam means, mounted within the housing, and acting on the plunger for urging the piercing end of the plunger into the canister to pierce the canister and release the pressurized gas therefrom;

an electrical power source mounted within the housing;

water sensor means, mounted on the housing and extending partially outward therefrom for generating an output signal when immersed in water;

a motor having a rotatable output shaft;

control means, mounted within the housing and connected to the electrical power source, the motor and the water sensor means, for activating the motor in response to the output signal from the water sensor means;

gear means, coupled between the output shaft of the motor and the cam means, for rotating the cam means upon rotation of the output shaft of the motor;

manual detecting means, mounted in the housing, for urging the piercing end of the plunger into the canister to pierce the canister and release the pressurized gas therefrom; and status indicator means, mounted within the housing and responsive to the control means, for indicating the operative state of the inflator.

* * * * *